United States Patent [19]

Ratera

[11] 4,084,479

[45] Apr. 18, 1978

[54] BRAIDING MACHINE

[76] Inventor: Eliseo Ratera, Polígono Industrial "ELS DOLORS" s/n. P.O. Box 228, Manresa (Barcelona), Spain

[21] Appl. No.: 750,195

[22] Filed: Dec. 13, 1976

[30] Foreign Application Priority Data

Dec. 23, 1975 Spain ..... 217.673

[51] Int. Cl.[2] ..... D04C 3/42; D04C 3/20

[52] U.S. Cl. ..... 87/48; 87/54

[58] Field of Search ..... 87/44–48, 87/50, 51, 33, 54–57

[56] References Cited

U.S. PATENT DOCUMENTS

| | | | |
|---|---|---|---|
| 695,601 | 3/1902 | Diss | 87/51 |
| 696,094 | 3/1902 | Diss | 87/51 X |
| 1,154,964 | 9/1915 | Bentley | 87/50 X |
| 1,196,463 | 8/1916 | Krenmayr | 87/51 |
| 3,748,952 | 7/1973 | Petzetakis | 87/50X |

*Primary Examiner*—John Petrakes
*Attorney, Agent, or Firm*—Brumbaugh, Graves, Donohue & Raymond

[57] ABSTRACT

A braiding machine of the type which includes a carrier for a bobbin, a pair of spaced apart tracks for guiding the carrier along a closed sinuous path, driving means for imparting driving movement to the carrier along said sinuous path and guiding means for guiding the yarn as it is pulled from the spindle of the carrier and characterized in that said guiding means includes a track follower carried by the carrier and accommodated within one of said tracks and a yarn guiding passage through the track follower for receiving the yarn on one side of the track, guiding it through the track within said track follower and discharging it on the opposite side of the track.

1 Claim, 2 Drawing Figures

BRAIDING MACHINE

This invention relates to braiding machines, and more particularly to a braiding machine in which yarn is guided and supported against centrifugal forces as it is unwound from a bobbin and directed to the forming means of the braiding machine while the bobbin carrier travels at very high velocity in a closed sinuous path.

The braiding machine of the present invention includes a carrier for a bobbin, a pair of spaced apart tracks for guiding the carrier along a closed sinuous path, driving means for imparting driving movement to the carrier at a high velocity along said sinuous path and means for guiding and supporting the yarn as it is unwound from a bobbin and advances through one of the tracks in its movement to the forming means. In thus supporting and guiding the yarn as it passes through the track, the centrifugal forces on the yarn are absorbed by the guiding means and the danger of breakage of the yarn as it is guided to the forming means is minimized.

Figure 1:
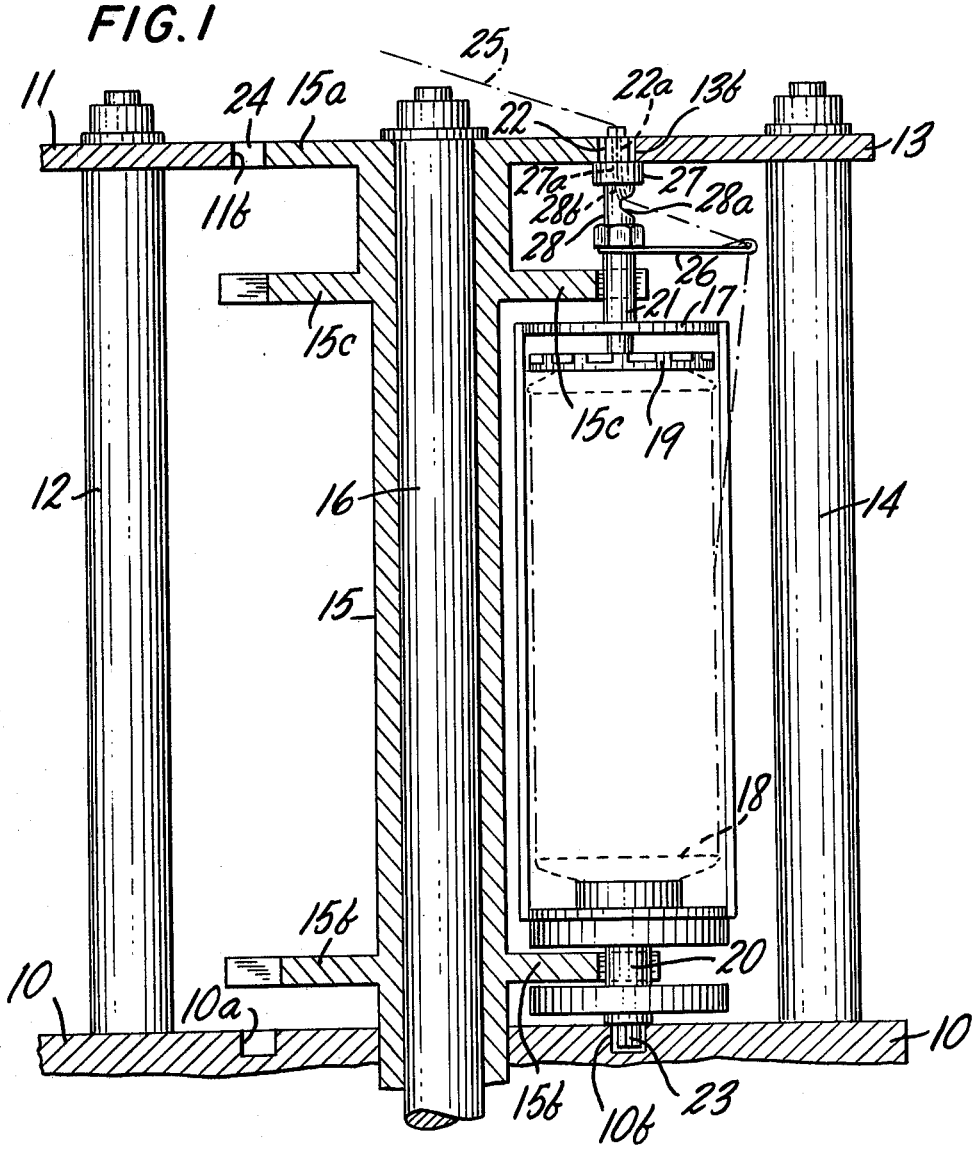
Figure 2:
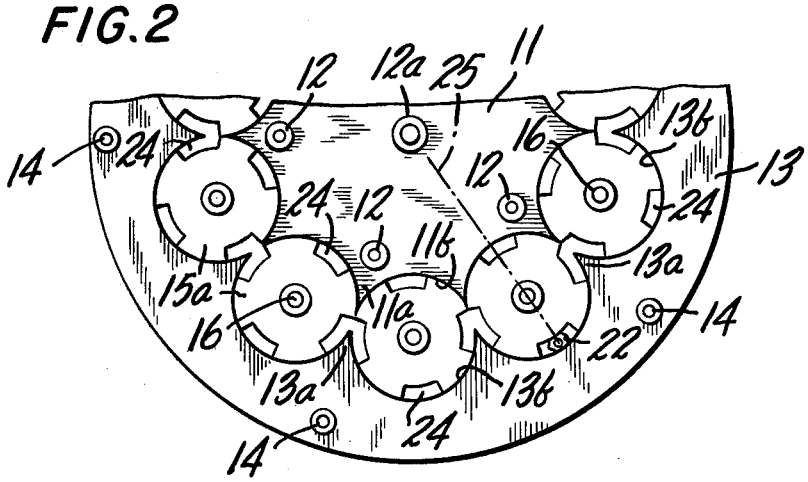

For a full understanding of the present invention, reference should be made to the more detailed description which follows and to the accompanying drawings, in which:

FIG. 1 is an elevational view, partly in cross-section, of part of a braiding machine embodying the present invention; and FIG. 2 is a plan view showing half of a braiding machine embodying the present invention.

The braiding machine shown in the drawings includes a base plate 10, a central star-shaped plate 11 supported above the base plate by a plurality of posts 12 and an outer ring-plate 13 supported above the base plate by posts 14. The inner and outer plates 11 and 13 are spaced apart at the same level and are formed with the outwardly extending points 11*a* of the inner plate spaced apart from but in line with inwardly extending points 13*a* of the outer plate, cooperating together so that plate edges 11*b* intermediate the points 11*a* and the plate edges 13*b* intermediate the points 13*a* define connected circular openings each of which accommodates the upper end plate 15*a* of a vertically disposed drive spindle 15. Each of the drive spindles 15 is mounted on and revolves with a spindle axle 16.

Each spindle 15 carries four sets of arms, each set including a lower fork-shaped arm 15*b* and an upper fork-shaped arm 15*c* for receiving a bobbin carrier 17 from an adjacent spindle, carrying it in a semi-circular path and delivering it to the other adjacent spindle, whereby the bobbin carrier 17 is carried in a closed sinuous path around the center post 12*a* of the braiding machine.

The carriers 17 are of the type which permit lateral insertion of a bobbin 18 with the lower end thereof rotatably held within the base of the carrier and the upper end held in place by a rotatable plate 19. The bobbin carrier 17 has a depending shaft 20 which is adapted to be engaged by the lower fork-shaped arm 15*b* of the spindle and an upwardly extending shaft 21 which is adapted to be engaged by the upper fork-shaped arm 15*c* of the spindle.

The extreme upper and lower ends of each bobbin carrier 17 carry a track follower 22 and 23, respectively. The upper circular end plate 15*a* contains plurality of notches 24 to accommodate the cam followers 22 as they travel along the sinuous path defined alternately by the outer edges 11*b* of the inner star-shaped plate 11 and the inner edges 13*b* of the outer ring-plate 13. The lower track followers 23 follow a similar sinuous path, being guided alternately in a track 10*a* directly beneath the track defined by the edge 11*b* and a track 10*b* directly beneath the track defined by the edge 13*b*.

As the yarn 25 is unwound from the bobbin it passes upwardly through an eyelet of an arm 26 extending outwardly from the upper shaft 21 and then through a yarn guiding passage which receives the yarn on one side of the track, guides it through the track nd discharges it on the opposite side of the track as it is advanced to the forming means above the star-shaped plate 11. More specifically, the yarn guiding means includes a hollow tubular support 27 for the track follower 22 and an element 28 connecting the upper shaft 21 and the tubular support 27. The tubular element 27 has a radial aperture 28*a* therein which introduces the yarn into a guiding passage 28*b* through the element 28 into an aligned central passage 27*a* in the tubular support 27 and then through an aligned passage 22*a* through the track follower 22.

As the yarn is unwound from the bobbin and the yarn is guided and supported as it passes through the upper track of the braiding machine, the centrifugal forces to which a free flowing yarn would be exposed are absorbed by the walls of the yarn guiding passage, thereby minimizing the risk of breakage.

The invention has been shown in a single preferred form and by way of example, and obviously many variations and modifications may be made therein within the spirit of the invention. The invention, therefore, is not intended to be limited to any specified form or embodiment except in so far as such limitations are expressly set forth in the claim.

I claim:

1. A braiding machine comprising a carrier for a bobbin, a pair of spaced apart tracks for guiding the carrier along a closed sinuous path, said pair of spaced apart tracks including a base plate for supporting the carrier and having a recessed sinuous track formed in the upper surface thereof and an upper star shaped plate surrounded by an outer ring plate both supported above the base plate, drive means for imparting movement to the carrier along said sinuous path, a track follower at the lower end of the carrier and riding within said recessed sinuous track in the base plate, a plurality of circular discs carried by said driving means intermediate the star shaped and outer ring plates, a recess formed in the outer periphery of each of said discs and moving relative to the outer edge of the star shaped plate and the inner edge of the outer ring plate, a track follower for said carrier interposed within said recess in the disc, so that as the driving means advances the carrier the track follower is guided along an outer edge of the star shaped plate or an inner edge of the outer ring plate within said recess, and means for guiding the yarn as it is unwound from a bobbin of a carrier, said guiding means including a yarn guiding passage for receiving the yarn on one side of the track, guiding it through the track follower and discharging it on the opposite side of the track.

* * * * *